US005492384A

United States Patent [19]

Tarko et al.

[11] Patent Number: 5,492,384

[45] Date of Patent: Feb. 20, 1996

[54] GOLFING EQUIPMENT CARRIER/RANGE STAND

[76] Inventors: John A. Tarko, 521 7th Ave., New Hyde Park, N.Y. 11040; John B. Beyer, 33 Knoll La., Glenhead, N.Y. 11545

[21] Appl. No.: 431,114

[22] Filed: Apr. 28, 1995

[51] Int. Cl.[6] ..... A63B 55/10

[52] U.S. Cl. ..... 294/143; 211/70.2; 294/146; 294/161

[58] Field of Search ..... 294/143, 146, 294/148, 159, 161, 162, 165, 166; 43/21.2; 206/315.2, 315.11, 443, 510; 211/60.1, 70.2, 70.8; 224/922

[56] References Cited

U.S. PATENT DOCUMENTS

| | | | |
|---|---|---|---|
| 2,990,865 | 7/1961 | Steele | 294/146 X |
| 3,215,181 | 11/1965 | Reed | 294/159 X |
| 3,483,996 | 12/1969 | Scammon | 294/143 |
| 4,036,416 | 7/1977 | Lowe | 294/143 |
| 4,526,414 | 7/1985 | Jones | 294/146 X |
| 4,666,038 | 5/1987 | Minneman | 294/146 X |
| 4,747,490 | 5/1988 | Smith | 206/315.2 X |
| 4,779,914 | 10/1988 | Friedline | 294/146 X |
| 5,209,539 | 5/1993 | Atalay | 294/143 |

*Primary Examiner*—Johnny D. Cherry
*Attorney, Agent, or Firm*—Michael J. Striker

[57] ABSTRACT

A golfing equipment carrier has a one-piece housing having an inverted cup shape with four substantially upright walls and an upper wall, the four walls including two opposite longitudinal walls and two opposite transverse walls, each of the longitudinal walls being provided with a plurality of inwardly bent longitudinal portions each forming an inner channel for snappingly retaining a golf club, the inwardly bent portions of each of the longitudinal walls being spaced from one another in an upright direction and extending in a longitudinal direction so as to be open at both longitudinal ends.

9 Claims, 1 Drawing Sheet

1
2
3
5
6
9
10
11
12

10
13

4

7
8
14

8

GOLFING EQUIPMENT CARRIER/RANGE STAND

BACKGROUND OF THE INVENTION

The present invention relates to a golfing equipment carrier.

Golfing equipment carriers are known in the art. Some of the golfing equipment carriers are disclosed for example in U.S. Pat. Nos. 3,215,181, 3,829,092, 4,747,490 and 5,234,114. The exacting golfing equipment carriers however can be further improved, in particular in the sense of increasing their stability as well as other properties.

SUMMARY OF THE INVENTION

Accordingly, it is an object of the present invention to provide a golfing equipment carrier which avoids the disadvantages of the prior art.

In keeping with these objects and with others which will become apparent hereinafter, one feature of the present invention resides, briefly stated, in a golfing equipment carrier which has a one-piece housing having an inverted downwardly expanding cup shape with four substantially upright walls and an upper wall, the four walls including two opposite longitudinal walls and two opposite transverse walls, each of the longitudinal walls being provided with a plurality of inwardly bent longitudinal portions each forming an inner channel for snappingly retaining a golf club, the inwardly bent portions of each of the longitudinal walls being spaced from one another in an upright direction and extending in a longitudinal direction so as to be open at both longitudinal ends.

When the device is designed in accordance with the present invention, it is very stable and is formed as a stand which can be used on a range, in car trunks and on shelves at home. It also is very convenient and easy to carry, since loose clubs are bulky to handle. The device is also a safety item which keeps loose clubs off the range floor where people can trip or step on loose clubs.

Since the holding means for holding the clubs are formed as inwardly bent portions of the device walls, the device as a whole is less cumbersome. The carrier in accordance with the present invention is a one-piece element which is very easy and inexpensive to manufacture.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
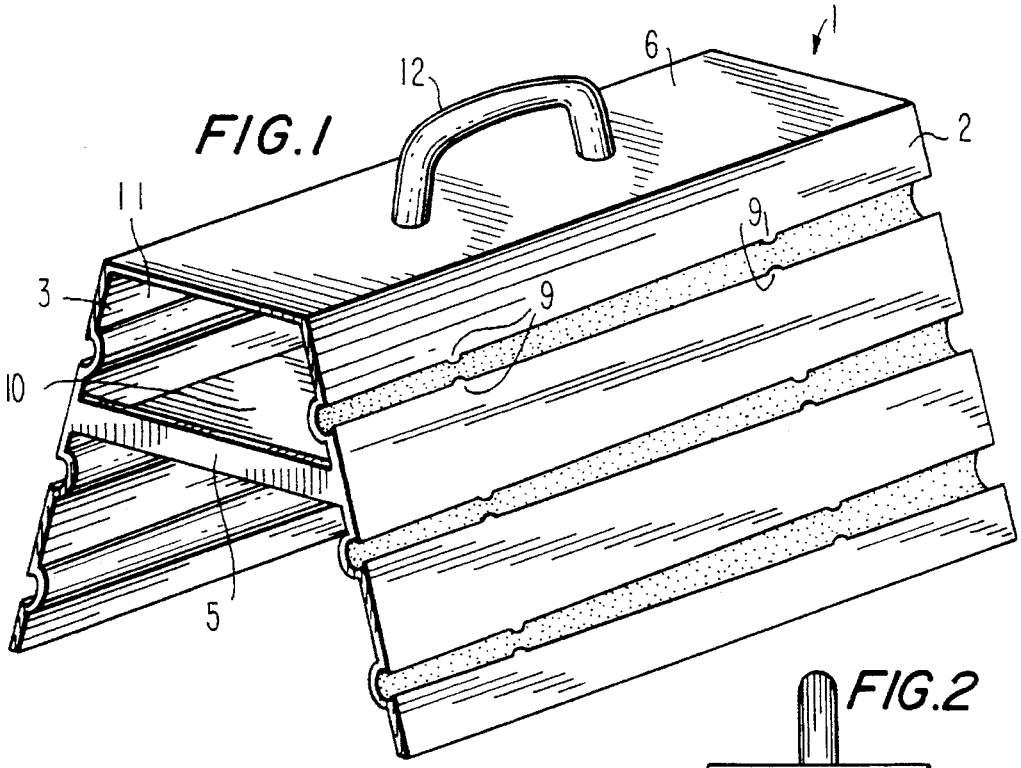
FIG. 1 is a perspective view of a golfing equipment carrier in accordance with the present invention.
Figure 3:
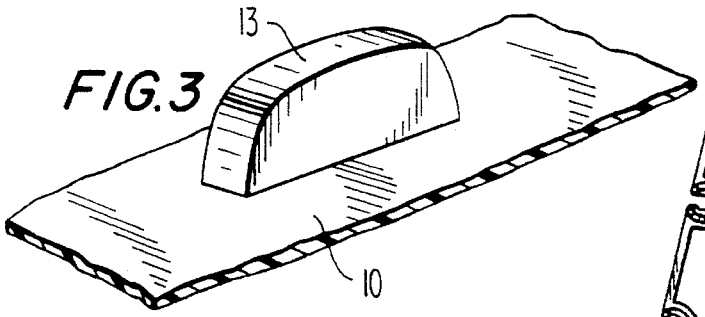
FIG. 3 is a perspective view of an intermediate wall of the golfing equipment carrier.
Figure 2:
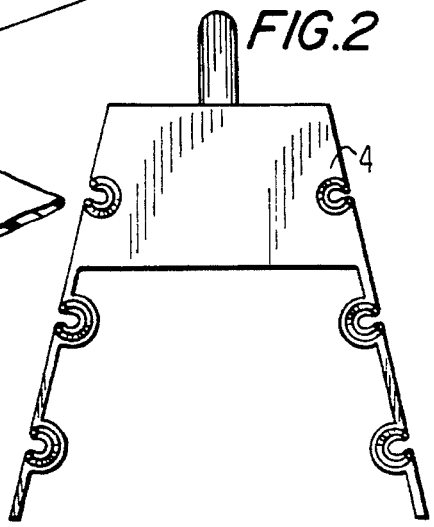
FIG. 2 is one end view of the inventive golfing equipment carrier.
Figure 4:
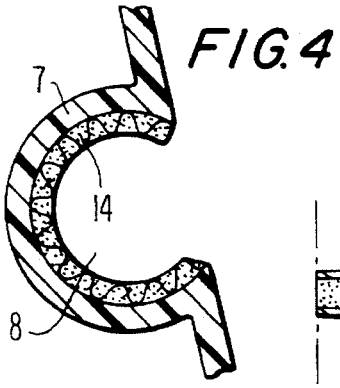
FIG. 4 is a cross-section of an inwardly bent wall portion of the golfing equipment carrier.

A golfing equipment carrier has a housing which is identified as a whole with reference numeral 1. The housing has an inverted cup shape and is provided with two longitudinal walls 2 and 3 and two transverse walls 4 and 5 located opposite to one another. As can be seen from FIG. 1, the walls 2, 3, 4, 5 extend downwardly from an upper wall 6 so that a distance between the longitudinal walls 2 and 3 and a distance between the transverse walls 4 and 5 increases downwardly. When the thusly formed carrier is placed on a supporting surface, it is very stable.

Each of the longitudinal walls 2 and 3 has a plurality of inwardly bent portions 7 each forming a longitudinal channel 8 for receiving a golf club. The channels 8 are open at both longitudinal ends of the corresponding longitudinal wall. Each inwardly bent portion 7 is provided with at least two constrictions which are longitudinally spaced from one another and each formed by two projections 9 extending toward one another in an upright direction. A golf club can be inserted into the corresponding channel 8 and held by the projections 9. For this purpose the longitudinal walls and the projections are formed of a resilient material, for example plastic material so that they can expand when the golf club is inserted into the channel 8 and then spring back to retain the golf club. The inwardly bent portions 7 perform a double function. In particular first of all they form channels 8 for receiving and retaining the golf clubs, and secondly they form corrugations which reinforce the longitudinal walls and increase the rigidity of the housing.

The housing 1 as a whole is formed as a one-piece element preferably composed of a synthetic plastic material. Such a housing is simple, easy and inexpensive to manufacture.

The carrier further has an intermediate wall 10 which extends substantially horizontally between the other walls. The right transverse wall 4 in the drawings completely closes a space between the intermediate wall 10, the upper wall 6 and the longitudinal walls 2 and 3. In contrast, the left transverse wall 5 extends upwardly from the intermediate wall 10 and does not reach the upper wall 6. The space between the intermediate wall 10, the longitudinal walls 2 and 3, and the transverse walls 4 and 5 form a compartment for storing some objects which a user can carry and prefers to store in the carrier when it is placed on the ground on the supporting surface.

The transverse walls 4 and 5 also perform the double function. In particular, first of all they connect the other walls with one another and therefore increase the rigidity of the housing, and secondly they form a compartment for small objects. The shorter transverse wall 5 leaves an opening 11 for introducing the small objects into the compartment, and at the same time prevents unintentional falling of the objects from the compartment, since it extends partially upwardly.

The carrier is further provided with a handle 12 for carrying the same. In accordance with an inventive feature, the intermediate wall 10 is provided in its central region with an upwardly bulging portion 13 with an interior exactly corresponding to the shape of the handle 12. Thereby, the carriers can be nested over one another, and the handle 12 of the lower carrier is inserted in the portion 13 of the upper carrier so that the nested carriers cannot move relative to one another in a horizontal direction.

As can be seen from the drawings, a soft liner or insert 14 is inserted in the channel 8 so as to improve the holding of the golf clubs and prevent their scratching by the material of the carrier. The insert 14 can be composed of soft fabric, felt, and any other suitable material.

Figure 5:
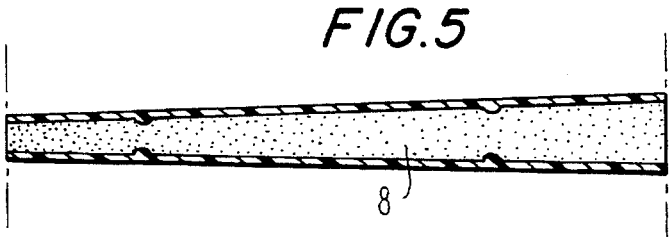
FIG. 5 is a view showing a shape of an opening in the carrier wall for holding a golf club.

As can be seen from FIG. 5, the channels 8 of the longitudinal walls have a transverse cross-section increasing from one end to another end of each longitudinal wall. This increasing cross-section substantially corresponds to the increasing cross-section of the golf club. As can be seen from the drawings, all channels 8 have the cross-section increasing in the same direction. Therefore, all golf clubs are oriented identically. In this construction the golf club heads face in the same direction. This can be considered as advantageous, since when a user carries the golfing equipment carrier, the heads somewhat tip the carrier and the tipped golf clubs do not interfere with a person who can walk behind the user.

It will be understood that each of the elements described above, or two or more together, may also find a useful application in other types of constructions differing from the types described above.

While the invention has been illustrated and described as embodied in a golfing equipment carrier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A golfing equipment carrier, comprising a one-piece housing having an inverted downwardly expanding cup shape with four substantially upright walls and an upper wall, said four walls including two opposite longitudinal walls and two opposite transverse walls, each of said longitudinal walls being provided with a plurality of inwardly bent longitudinal portions each forming an inner channel for snappingly retaining a golf club, said inwardly bent portions of each of said longitudinal walls being spaced from one another in an upright direction and extending in a longitudinal direction so as to be open at both longitudinal ends.

2. A golfing equipment carrier as defined in claim 1; and further comprising an intermediate substantially horizontal wall extending between said four walls and connecting said four walls with one another at a location which is spaced vertically downwardly from said upper wall.

3. A golfing equipment carrier as defined in claim 2, wherein one of said transverse walls extends between said intermediate wall and said upper wall and between said longitudinal walls so as to close a space between the same, while another of said transverse walls extends from said intermediate wall upwardly toward said upper wall but ends before said upper wall so as to leave an object receiving opening in said other transverse wall.

4. A golfing equipment carrier as defined in claim 2; and further comprising a handle attached to said upper wall, said intermediate wall having an upwardly bulging portion which is shaped as a receptacle for a handle of another carrier so that when several carriers are nested over one another, said handles of said carriers are received in said receptacles correspondingly.

5. A golfing equipment carrier as defined in claim 1; and further comprising a handle attached to said upper wall.

6. A golfing equipment carrier as defined in claim 1, and further comprising a plurality of inserts inserted in said channels and composed of a soft material.

7. A golfing equipment carrier as defined in claim 1, wherein said inwardly bent portions are formed so that said channels have a cross-section which increases in the longitudinal direction of said longitudinal walls.

8. A golfing equipment carrier as defined in claim 1, wherein each of said inwardly bent portions of each of said longitudinal walls has upwardly extending sections which reduce a cross-section of each of said channels so as to retain a golf club in the region of said sections.

9. A golfing equipment carrier as defined in claim 1, wherein said housing has a shape of a truncated pyramid.

* * * * *